US007012488B2

(12) United States Patent
Beis et al.

(10) Patent No.: US 7,012,488 B2
(45) Date of Patent: Mar. 14, 2006

(54) CAVITY RESONATOR HAVING AN ADJUSTABLE RESONANCE FREQUENCY

(75) Inventors: Konstantin Beis, Backnang (DE); Uwe Rosenberg, Backnang (DE)

(73) Assignee: Marconi Communications GmbH, Backnang (DE)

( * ) Notice: Subject to any disclaimer, the term of this patent is extended or adjusted under 35 U.S.C. 154(b) by 0 days.

(21) Appl. No.: 10/221,045

(22) PCT Filed: Feb. 23, 2001

(86) PCT No.: PCT/IB01/00431

§ 371 (c)(1),
(2), (4) Date: Nov. 18, 2002

(87) PCT Pub. No.: WO01/67543

PCT Pub. Date: Sep. 13, 2001

(65) Prior Publication Data

US 2003/0102943 A1 Jun. 5, 2003

(30) Foreign Application Priority Data

Mar. 7, 2000 (DE) ..... 100 10 967

(51) Int. Cl.
*H01P 7/06* (2006.01)

(52) U.S. Cl. ..... 333/233; 333/231

(58) Field of Classification Search ..... 333/231, 333/232, 233, 227

See application file for complete search history.

(56) References Cited

U.S. PATENT DOCUMENTS 3,771,074 A 11/1973 Fletcher ..... 333/229
6,118,356 A * 9/2000 Loi et al. ..... 333/209

FOREIGN PATENT DOCUMENTS

EP 0704926 4/1996
JP 10-303478 2/1999

* cited by examiner

*Primary Examiner*—Stephen E. Jones
(74) *Attorney, Agent, or Firm*—Kirschstein, et al.

(57) ABSTRACT

The aim of the invention is to provide a cavity resonator that has a great variable frequency area of a resonance frequency and is provided with good quality. Such a cavity resonator is provided with a round cross-section. The H11n in wave mode acting as the resonance wave mode exists in said resonator which is separated into two components with regard to the cross-sectional plane (5) thereof. The two cavity components (1, 2) can be displaced against each other in the direction of the common longitudinal axis (7) thereof.

4 Claims, 1 Drawing Sheet

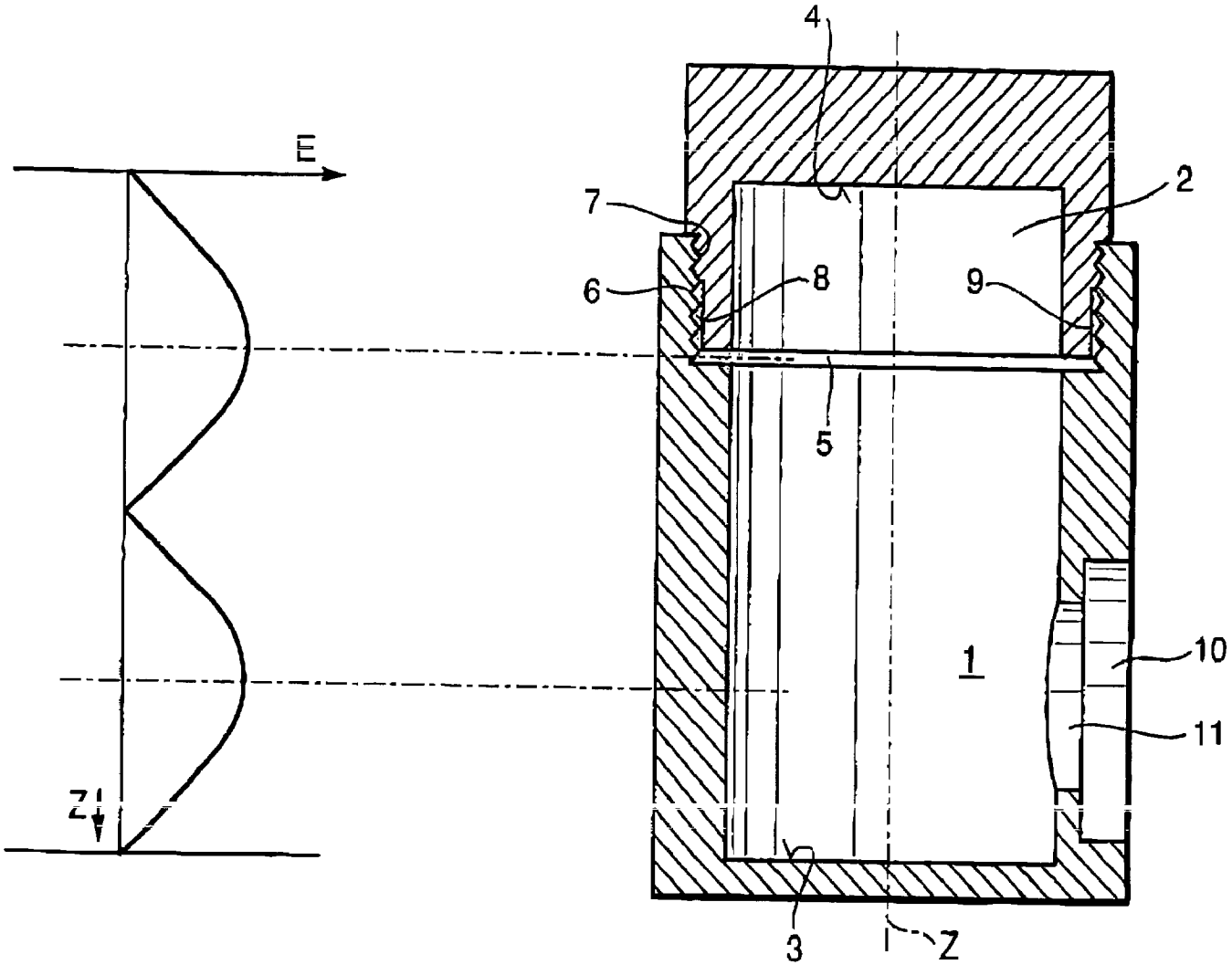
2
10
11
9
1
Z
4
8
5
3
7
6
E
Z

CAVITY RESONATOR HAVING AN ADJUSTABLE RESONANCE FREQUENCY

PRIOR ART

The present invention concerns a cavity resonator with tunable resonance frequency having a round cross section and in which the H11n wave type (n is a whole positive number) exists as resonance wave type, the spacing of the two faces of the cylindrical cavity being variable.

Microwave filters with limited losses are ordinarily made from several cavity resonators coupled together. In order to be able to tune the filter to a desired frequency range, means are required with which the individual cavity resonators can be tuned into their resonance frequency. As follows, for example, from "The Dual-Mode Filter—A Realization", R. V. Snyder, The Microwave Journal, December 1974, pp. 31–33, the resonance frequency of the cavity resonator is tuned by varying its length. This occurs according to the mentioned document in that a complete face of the cylindrical cavity resonator is mounted movable. Such a design of frequency-tunable cavity resonators also follows from "Microwave Filters, Impedance-Matching Networks, and Coupling Structures", Matthaei, Young, Jones, McGraw-Hill Publishers, 1964, pp. 921–923. The movable face of the cavity resonator here is electrically connected to the cavity wall by sliding contacts. A cavity resonator with such tuning devices has a relatively high insertion loss; this means that high quality cannot be achieved with such a cavity resonator.

The underlying task of the invention is to offer a cavity resonator of the type just mentioned that has a large frequency tuning range and has the highest possible quality in order to be able to implement filters with very low insertion loss that are tunable over a large frequency range.

ADVANTAGES OF THE INVENTION

The mentioned task is solved with the features of claim 1 in that the cavity resonator, which has a round cross section and in which the H11n wave type exists as resonance wave type, is divided into two parts with reference to the cross-sectional plane and that both cavity parts can be moved relative to each other in the direction of their common longitudinal axis. The two cavity parts that can be moved relative to each other in the axial direction only have a slight adverse effect on the quality of the cavity resonator. A cavity resonator tunable in its frequency that has very high quality and therefore permits implementation of the filter with a very low insertion loss can thus be implemented.

Expedient modifications of the invention follow from the dependent claims. If a cross-sectional plane that lies roughly in the region of a maximum of the electrical field strength of the H11n wave type is chosen as separation plane between the two hollow cavity parts, almost no adverse effect on quality of the cavity resonator occurs.

An advantageous mechanical and electrical connection between the two cavity parts is produced, in that one cavity part is provided with outside thread and the other cavity part with inside thread so that both cavity parts can be screwed one into the other with variable spacing of their faces. It is then expedient that the cavity part provided with inside threads have a shoulder with an enlarged inside diameter in the region of the separation plane, on whose interior the inside thread is situated. With this expedient, a situation is achieved in which the inside cross sections of both cavity parts are equally large.

DESCRIPTION OF A PRACTICAL EXAMPLE

A longitudinal section through a cylindrical cavity resonator is shown in the only FIGURE of the drawing. The cavity resonator with reference to its cross-sectional dimensions is dimensioned so that the H112 wave type is present in it as resonance wave type. In order to be able to tune the resonance frequency of the cavity resonator, it is divided into two cavity parts 1 and 2. The first face 3 of the cylindrical cavity resonator is situated in cavity part 1 and the cavity part 2 has the opposite face 4 of the cavity resonator. Frequency tuning of the cavity resonator is possible, in that the spacing between the two faces 3 and 4 is variable in the direction of the cavity resonator longitudinal axis z.

In addition to the longitudinal section through the cavity resonator, the distribution of electrical field strength of the H112 wave type in the cavity resonator is shown with reference to its longitudinal axis z. The separation plane 5 between the two cavity parts 1 and 2 is placed in a cross-sectional plane of the cavity resonator in which a maximum of electrical field strength E is found. With this division of the cavity resonator into two, the lower cavity part 1 forms about ¾ and the upper cavity part 2 about ¼ of the total cavity.

A mutual axial displacement of the two cavity parts 1 and 2 for the purpose of frequency tuning is achieved, in that one of the two cavity parts, here cavity part 1, is provided on the inside of its open end with an inside thread 6 and the other cavity part 2 is provided on its open end on the outside with outside thread 7. It is thus possible to screw both cavity parts 1 and 2 one into the other and adjust the spacing between the two faces 3 and 4 that influences the resonance frequency of the cavity resonator. The cavity part 1 preferably has a shoulder 8 on its open end with an enlarged diameter relative to the normal cavity cross section and the inside thread 6 is situated on the inside of this shoulder 8. The hollow cavity part 2 can be screwed into this shoulder 8 so that the cavity part 2 can maintain the same dimensions of the inside cross section as cavity part 1.

The gap required in the separation 5 between the two cavity parts 1 and 2 is laid out in dimension so that it lies symmetric to the maximum of electrical field strength E when the screw-in depth of cavity part 2 corresponds to tuning of the cavity resonator to its middle frequency position. During tuning to the upper or lower frequency position, there are certain symmetry deviations of the separation gap relative to the maximum electrical field strength E, which, however, are very limited and have no noticeable effect on the quality of the cavity resonator. At a high tuning frequency, the separation would be almost closed, whereas during tuning to the lowest frequency position it is higher. At the selected position of the separation gap between the hollow cavity parts 1 and 2, the resonance wave type H11n can be tuned over a frequency range of about 10%. The separation gap can then be up to 0.1 times the corresponding cavity resonator wavelength of the residence wave type without an effect on quality being noticeable, since almost no wall currents flow over the separation site at this size of the separation gap and therefore no energy is decoupled into the gap.

The hollow cavity part 2 has an undercut 9 on the lower end protruding into hollow cavity 1 which serves to compensate for the tolerances between the two parts. This undercut 9 has no electrical significance.

In the depicted practical example, a coupling opening 10 with an inductive coupling aperture 11 is inserted in the lower cavity part 1 in the region of the lower field strength maximum, via which coupling of an additional cavity resonator can occur. Other coupling devices are also possible, for example, probes extending into the cavity resonator that couple the electrical field components. Inductive coupling apertures that couple the transversal magnetic field components (Hr and/or Hö) and are arranged for this purpose at positions with almost maximum field strength of the corresponding field components are also possible on the inductive coupling apertures arranged on the faces and present on the periphery of cavity resonator.

Since the resonance wave type H11n employed here degenerates below 90°, two resonance circuits can be implemented by the degenerated wave types of the geometric cavity and simultaneously tuned with the device just described. Because of this the total size of the filter and the expense for the active total tuning device are significantly reduced. Coupling of the dual wave types in the cavity can be carried out in known fashion with discontinuities—ordinarily screws, which are arranged at 45° with reference to the orientation of the electrical field components of the dual wave types on the periphery of the cylindrical cavity. In addition, a base correction of the frequency positions of the two wave types can be carried out relative to each other in known fashion by additional tuning screws on the periphery of the cavity, which is necessary during filter implementation owing to the different coupling loads.

What is claimed is:

1. A cavity resonator, comprising:

a cylindrical cavity having a tuneable resonance frequency and a round cross-section, and in which an H11n wave type exists as a resonance wave, the cavity having two faces spaced apart by a variable spacing, the cavity being divided into two parts with reference to a cross-sectional plane located at a center of the variable spacing, the cross-sectional plane lying in a region of a maximum of electrical field strength of the H11n wave type at a separation plane between the two cavity parts, and both cavity parts being movable relative to each other in a direction of a common longitudinal axis.

2. The cavity resonator according to claim 1, in that one cavity part is provided with an outside thread, and the other cavity part is provided with an inside thread, both cavity parts being screwed one into the other with the variable spacing between the faces.

3. The cavity resonator according to claim 2, in that the other cavity part has a shoulder with an enlarged inside diameter in a region of the separation plane at one side of which the inside thread is situated.

4. The cavity resonator according to claim 1, and comprising: a coupling opening in a cylindrical wall of one of the cavity parts to provide inductive coupling with an interior of the resonator.

* * * * *